United States Patent [19]

Krings

[11] 4,345,857

[45] Aug. 24, 1982

[54] CONSTRUCTION PLATE FOR A DITCH CONSTRUCTION DEVICE

[76] Inventor: Josef Krings, Hans-Böckler-Str. 23, D-5138 Heinsberg-Oberbruch, Fed. Rep. of Germany

[21] Appl. No.: 210,720

[22] Filed: Nov. 26, 1980

[30] Foreign Application Priority Data

Dec. 1, 1979 [DE] Fed. Rep. of Germany ..... 2948458

[51] Int. Cl.[3] ..... E21D 5/12

[52] U.S. Cl. ..... 405/282; 405/272; 405/283

[58] Field of Search ..... 405/272–284, 405/149; 52/580, 584

[56] References Cited

U.S. PATENT DOCUMENTS

| | | | |
|---|---|---|---|
| 2,865,178 | 12/1958 | Wicke | 405/283 |
| 3,001,613 | 9/1961 | McBerty | 52/580 |
| 3,937,026 | 2/1976 | Krings | 405/282 |
| 3,969,852 | 7/1976 | Krings | 405/282 |
| 4,054,033 | 10/1977 | Pillosio | 405/282 |
| 4,070,844 | 1/1978 | Elze | 52/584 |

*Primary Examiner*—Dennis L. Taylor
*Attorney, Agent, or Firm*—Allison C. Collard; Thomas M. Galgano

[57] ABSTRACT

A construction plate for a ditch construction device consists of profiled steel elements which are rigidly coupled with each other and covered with cover plates. At the small sides of the construction plate, profiled steel elements are provided in the form of hollow profiles which are provided with guide heads for coupling adjacent supports or construction plates. The construction plate is provided with at least one vertical hollow profile having on the inner side of the construction plate superimposed horizontal slot openings. A C- or U-shaped profiled guide bar supports horizontally-disposed joints on the rear side of its ribs which are insertable through the slot openings of the vertical throughput openings which are aligned with respect to each other, and insertable therein is a locking rod which engages the joints and/or the hollow profile with wedge elements.

12 Claims, 7 Drawing Figures

CONSTRUCTION PLATE FOR A DITCH CONSTRUCTION DEVICE

The present invention relates to a construction plate for a ditch construction device consisting of profiled steel elements which are rigidly coupled with each other and covered with cover plates, whereby at the small sides of the construction plate, steel elements are provided in the form of hollow profiles, which are provided with guide heads for coupling adjacent supports or construction plates.

A so-called "edge support plate" in the form of a construction plate is known from German Auslegesschrift No. 24 56 690 which is insertable into vertical supports with bar-like guide heads which are mounted on the small sides of the hollow profiles, and which can be alternately and stepwise lowered into the ground, together with the supports.

Construction plates are known which may be lowered into the ground, for example, a ditch or the like, which do not require supports and which carry at their lateral ends guide bars facing the inside thereof on which either struts or further construction plates may be mounted at a right angle thereto. These construction plates are also called "shaft construction plates", because they may form a construction shaft when three or four plates are coupled together.

Finally, construction plates are known which have a vertical guide bar in their center, wherein the struts are received. These types of structures are known as "center support plates". They may be installed without any supports and engage with each other with overlapping guide heads or bars.

For the contractor, such construction plates represent a considerable amount of the operating capital, and it is important that the available operating capital be used as best as possible. Therefore, it is desirable to keep the number of types of construction plates as low as possible, and to make the available construction plates as versatile as possible.

It is therefore an object of the present invention to provide a construction plate which may be changed into at least two of the aforementioned construction plates without any large expense, thus enabling a better use of the construction plates.

This object of the invention is obtained in that the construction wall is provided with at least one vertical hollow profile having on the inner side of the construction wall, superimposed horizontal slot openings. A C- or U-shaped profile guide bar supports horizontally-disposed joints on the rear side of its rib. These joints are insertable through the slot openings of the vertical hollow profile and they, in turn, have vertical throughput openings which are aligned with respect to each other, in which is insertable a locking member which engages the joints and/or the hollow profile with wedge elements.

With the inventive embodiment, it is possible to convert an edge support plate into a shaft plate by mounting the guide bar with only a few manipulations. This permits, for example, the closing of a ditch or the lining of ditch enlargements, wherein the normally used supports are not applicable. Instead of a special plate, only the additional guide bars and locking elements are required. If the construction plate is a hollow profile with slot openings in the center, the plate can be converted into a center support plate. Thereby, a simple and essential construction unit is obtained.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits of the invention.

In the drawings, wherein similar reference characters denote similar elements throughout the several views.

Figure 1:
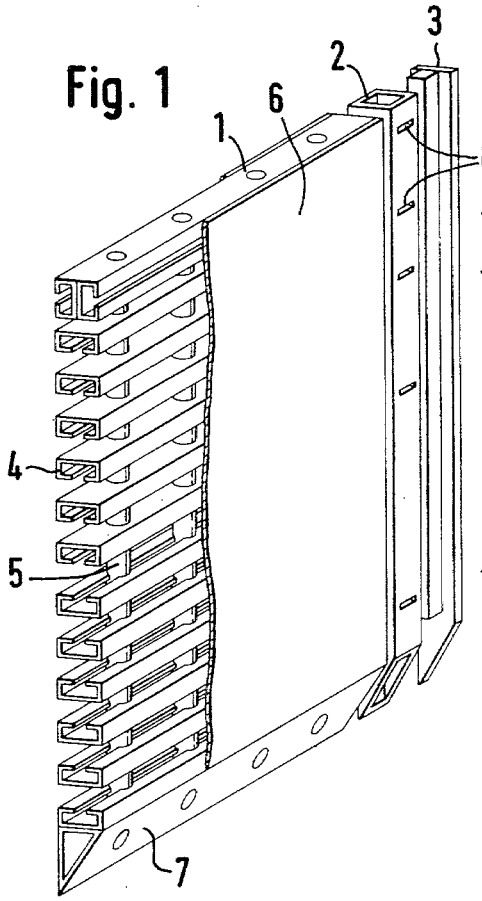
FIG. 1 is a fragmentarily-illustrated, partially-exploded, perspective view of a construction plate in accordance with the invention, with portions broken away to show internal construction.

Referring now in detail to FIG. 1, a construction plate is illustrated consisting of a main portion 1, at least one vertically-extending hollow profiled bar 2, and one guide head 3 mounted on each of the small sides. Main portion 1 may be constructed in any given manner. For example, it may comprise tightly-disposed steel profiles or, as shown, it may consist of horizontally-disposed C-shaped supports 4 which are vertically spaced apart from each other by means of pipes 5 which run vertically or perpendicularly therethrough. These members are covered on both sides with cover plates 6, and a lower part 7 of the construction plate is bevelled and shaped like a cutter.

Guide head 3 may consist of a C-profile support, a pipe profile or, as shown, a T-shaped support bar which is insertable into a guide bar of a correspondingly-shaped support or an adjacent construction plate.

The vertical hollow-profiled bar 2 is provided with superimposed spaced-apart horizontal slot openings 8 on the inside surface thereof.

Figure 2:
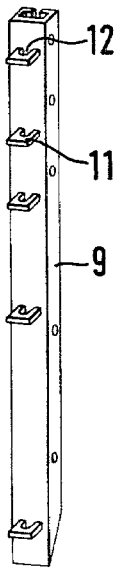
FIG. 2 is a perspective view of a guide bar.

For converting the construction plate of FIG. 1 into a shaft construction plate, a guide bar 9 (FIG. 2) is provided having a U- or C-shaped profile, whose dimensions are sufficient to receive superimposed shoes of struts (not shown) or a guide head of a further construction plate which is disposed at a right angle with respect to the construction plate.

Figure 3:
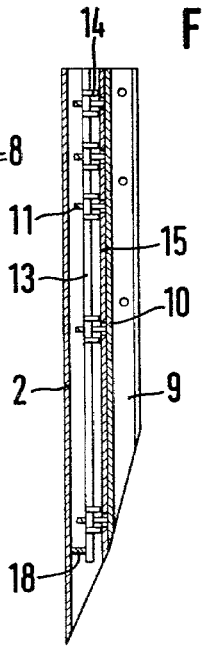
FIG. 3 is a vertical, cross-sectional view through a construction plate, with a guide bar mounted thereon.
Figure 4:
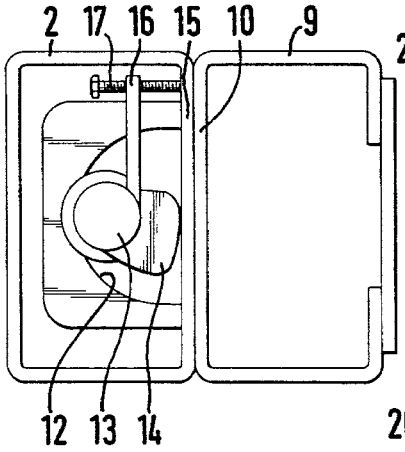
FIG. 4 is an enlarged plan view of a hollow profile and a guide bar coupled therewith.

Guide bar 9 is provided at its rear side rib 10 with horizontally-disposed joints or fish plates 11 which have a semicircular-shaped throughput opening 12 (FIG. 4). When joints 11 are inserted through slot openings 8, a locking rod 13 is inserted through the superimposed and aligned throughput openings 12. Cam-like, pivot wedges 14 are mounted on the locking rod at distances corresponding to the distances of joints 11 for engagement with the inner side of the wall 15 of hollow profile 2 provided with slot openings 8, when rotating locking rod 13. As shown in FIG. 3, it is necessary to provide a pivot wedge 14 above and below joint 11.

A radially-extending lever arm 16 is provided on the upper end of locking rod 13 which supports on its free end a support screw 17 which engages on a wall of hollow profile 2, thus maintaining pivot wedges 14 under tension.

On the inner side of the rear wall on the lower end of hollow profile 2, a support plate 18 for locking rod 13 is welded thereon.

Figure 6:
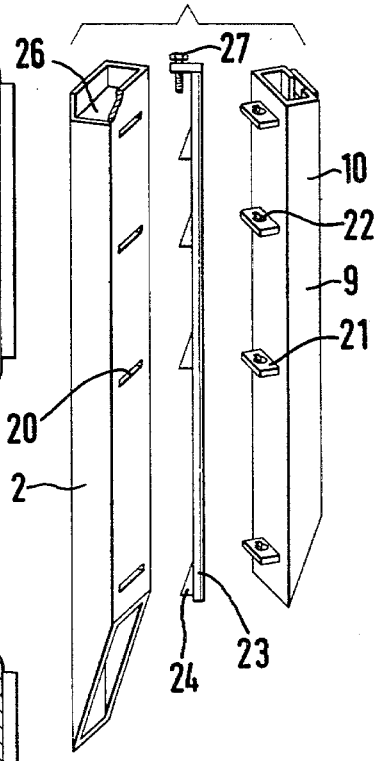
FIG. 6 is a perspective view of a hollow profile, a locking rod and a guide bar of the embodiment in accordance with FIG. 5.
Figure 5:
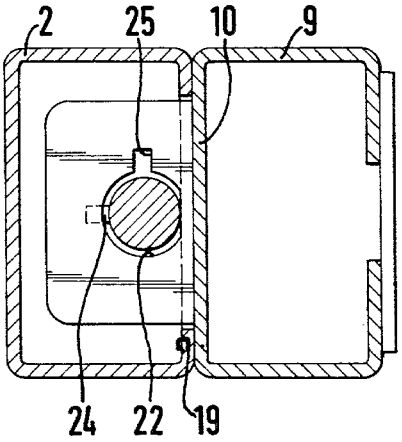
FIG. 5 is an enlarged plan view similar to FIG. 4, but showing another embodiment of the invention.
Figure 7:
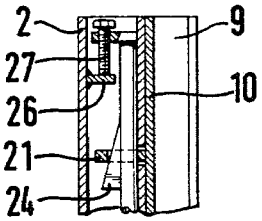
FIG. 7 is a partially-reduced, vertical cross-sectional view through a hollow profile, with a guide bar coupled thereto, in accordance with the embodiment of FIG. 5.

FIGS. 5–7 illustrate another embodiment of the invention. Here too, horizontal joints 21 are welded to the rear wall of guide bar 9 which are insertable through slot openings 20 in hollow profile 2. In contrast to the aforedescribed embodiment, superimposed aligned throughput openings 22, in the form of bores, are provided in joints 21 and may be chamfered at the side towards the facing rib 10 of guide bar 9, or may be overlapped by the inner face 19 of front wall 15 of hollow profile 2. Parallel to this front wall 19, a rectangular recess 25 is provided adjacent to each throughput opening 22.

As can be seen in FIG. 6, locking rod 23 serves to couple hollow profile 2 to guide bar 9. Locking bar 23 has axially-directed flat wedges 24 which taper upwardly. They are so dimensioned that they can be inserted through throughput openings 22 and recesses 25.

After assembling guide bar 9 on hollow profile 2, locking rod 23 is first pushed from the top through the superimposed, aligned throughput openings 22, 25 and is subsequently turned by about 90° into the position shown in FIG. 5. In this position, the tension bolt 27 which is mounted on the upper end of locking rod 23 presses against against a support plate 26, which is welded to hollow profile 2, thus pressing locking rod 23 against the front wall 15 of hollow profile 2 (FIG. 7). Simultaneously, guide bar 9 is pulled tightly to hollow profile 2.

Basically, hollow profile 2 is disposed immediately adjacent to guide head 3. However, it is also possible to mount the hollow profiles 2 at other locations on the construction plate, for example, in the center, so that center support plates may be formed in a simple manner by attaching a guide bar 9.

Thus, while only several embodiments of the present invention have been shown and described, it will be obvious that many changes and modifications may be made thereunto, without departing from the spirit and scope of the invention.

What is claimed is:

1. In a construction plate for a ditch construction device of the type comprising profiled steel elements which are rigidly coupled together, cover plates covering said steel elements and profiled steel elements in the form of hollow profiles mounted adjacent the small sides of the construction plate and provided with guide heads for coupling adjacent supports or construction plates, the improvement comprising:

at least one vertically-disposed hollow profile having a wall facing the inner side of said construction plate and having a plurality of vertically spaced-apart and aligned horizontally-disposed slot openings formed therein;

a profiled guide bar having a rear side rib with a plurality of vertically spaced-apart and aligned horizontally-extending joint plates disposed for insertion through said openings of said hollow profile, said joint plates each having vertically-extending and aligned throughput openings formed therein vertically aligned with the throughput openings of the other plates; and a locking rod insertable through said throughput openings, said locking rod having wedge elements for engaging said joint plate and/or hollow profile.

2. The construction plate according to claim 1, wherein at least one vertical hollow profile is shaped into a hollow profile having slot openings and is coupled to a guide head.

3. The construction plate according to claim 1, wherein said hollow profile is a rectangular profile.

4. The construction plate according to claim 1, wherein said hollow profile is a C-shaped profile.

5. The construction plate according to claim 1, wherein said throughput openings are so disposed that they extend through the inner side of said slotted wall of the hollow profile when said joint plates are inserted in said hollow profile.

6. The construction plate according to claim 1, wherein said wedge elements are cam-like pivot wedges and wherein a locking device is provided on the upper end of said locking rod.

7. The construction plate according to claim 1, wherein said wedge elements are axial upwardly-tapering flat wedges, wherein recesses are provided in said joint plates adjacent to throughput openings for inserting said flat wedges and wherein a locking device is provided at the upper end of the locking rod.

8. The construction plate according to claim 6, wherein the locking device consists of a radially- and horizontally-extending lever arm mounted on said locking rod and a horizontally-extending support screw mounted on the free end of said lever arm which is supported against a wall of said hollow profile.

9. The construction plate according to claim 7, wherein said locking device comprises a radially- and horizontally-extending lever arm which at its free end supports a support screw disposed parallel to said locking rod, and wherein a support plate is provided on said hollow profile for cooperation with said support screw.

10. The construction plate according to claim 1, wherein said hollow profile having horizontally-disposed slot openings is centrally-disposed in said construction plate.

11. The construction plate according to claim 1, wherein said guide bar has a C-shaped profile.

12. The construction plate according to claim 1, wherein said guide bar has a U-shaped profile.

* * * * *